United States Patent [19]

Meunier et al.

[11] Patent Number: 4,534,937

[45] Date of Patent: Aug. 13, 1985

[54] PROCESS FOR SINTERING ALUMINUM ALLOY POWDERS UNDER PRESSURE

[75] Inventors: Jean Meunier, Voreppe; Marc Salesse, Paris, both of France

[73] Assignee: Cegedur Societe de Transformation de L'Aluminium Pechiney, Paris, France

[21] Appl. No.: 479,900

[22] Filed: Mar. 29, 1983

[30] Foreign Application Priority Data

Mar. 10, 1983 [FR] France ..... 83 04343

[51] Int. Cl.[3] ..... F16N 15/08

[52] U.S. Cl. ..... 419/42; 419/49; 419/68; 75/122.1; 75/247; 75/249

[58] Field of Search ..... 419/42, 49, 68; 75/122.1, 247, 249

[56] References Cited

U.S. PATENT DOCUMENTS

| | | | |
|---|---|---|---|
| 2,878,140 | 3/1959 | Barr | 419/49 X |
| 3,419,387 | 12/1968 | Gordon et al. | 419/42 X |
| 4,109,374 | 8/1978 | Whetstone et al. | 174/128 S X |
| 4,388,054 | 6/1983 | Larsson | 419/49 X |

FOREIGN PATENT DOCUMENTS

| | | | |
|---|---|---|---|
| 35784 | 9/1981 | European Pat. Off. | 419/49 |
| 67841 | 3/1958 | France . | |
| 67842 | 3/1958 | France . | |
| 67843 | 3/1958 | France . | |
| 1354356 | 1/1964 | France | 419/42 |
| 2239846 | 8/1977 | France . | |
| 56-18641 | 4/1981 | Japan | 419/42 |

*Primary Examiner*—Stephen J. Lechert, Jr.

*Attorney, Agent, or Firm*—Oblon, Fisher, Spivak, McClelland & Maier

[57] ABSTRACT

This invention relates to a process for sintering aluminum alloy powders under pressure.

It consists in placing the powder in a capsule, in coating the capsule with an easily melted, stable vitreous material with a viscosity between $10^2$ and $10^5$ poises at the sintering temperature and in pressing it in a unidirectional press.

It applies, in powder metallurgy, to the obtaining of castings that exhibit homogeneous mechanical properties, these castings being able to be roughcasts or finished castings.

10 Claims, No Drawings

PROCESS FOR SINTERING ALUMINUM ALLOY POWDERS UNDER PRESSURE

This invention relates to a process for sintering aluminum alloy powders under pressure.

In addition to standard processes for molding or for forging of cast products, it is known that the shaping of aluminum alloys can be performed by a pressing of powders followed by sintering.

According to the latter type of process, the pressing of the powders can be done in two ways:

On the one hand, uniaxially, i.e., the charge of powder placed in the cavity of a mold is subjected, in a determined direction, to the action of a mobile punch moving toward the press table. Under these conditions, on an average, relatively high pressures, on the order of 800 MPa, can be reached. However, this type of pressing exhibits a drawback due to the fact that since the powder layers located in the vicinity of the mobile punch are the most compressed, they rest on the side walls of the mold, and the resultant friction reduces proportionately the pressing force transmitted to the lower layers so that the voluminal mass of the casting thus obtained is not uniform and decreases with its height. This heterogeneity, then, has resulted in differences in mechanical properties from one point to another of the casting. Of course, the use of presses with two mobile punches, or further, the addition of a lubricant such as stearates make it possible to diminish this drawback, but in proportions most often insufficient to reach the desired homogeneity.

On the other hand, the pressing can also be done isostatically, i.e., the powder is placed in a mold of flexible and fluid-tight material such as rubber or a plastic which is immersed in a fluid on which a pressure is exerted.

The advantage of this isostatic pressing results in the obtaining of a voluminal mass uniform at every point of the casting and, consequently, a homogeneity of its mechanical properties. However, the allowable pressures in this type of pressing are at most about 300 MPa and, therefore, lower than those that can be reached in the unidirectional presses.

No matter what the manner of compressing it, the casting resulting from a simple cold pressing of powders is certainly relatively strong, but it totally lacks plasticity and exhibits considerable porosity. That is why, after pressing, a consolidation by a heat treatment called "sintering" is performed, during which the borders between the powder grains disappear and, thus, a casting with lower porosity and better plasticity is prepared, but whose mechanical properties are still quite different from those of castings obtained by traditional metallurgy.

However, it has been observed that the properties of the sintered castings could be markedly improved by combining into a single operation the pressing and the sintering, which is called sintering under pressure or hot pressing.

This sintering under pressure can be done according to the two types of pressing mentioned above. Thus, in uniaxial pressing, the pressure of the punch is applied on the powder while simultaneously heating the mold, whereas in isostatic pressing, the powder is first placed in a metal capsule, then the unit is brought to the appropriate temperature while at the same time exerting a pressure by means of a hot inert gas such as argon or nitrogen.

However, the drawbacks inherent in each of the types of pressing are found again when hot, namely, for the uniaxial, pressing states different from one point to another of the casting and, consequently, a heterogeneity of the mechanical properties; for the isostatic, a pressure limited to 300 MPa, a drawback to which will be added problems of relatively long cycle times for raising and lowering pressure and temperature in relation to those required by the uniaxial operations.

For this reason the applicant has sought to develop a process for sintering under pressure whose purpose is to reach the cycle times and pressures normally achieved uniaxially while imparting to the manufactured products the homogeneity of properties generally obtained isostatically.

This process consists in using a powder previously placed in a capsule and is characterized by the fact that the capsule is coated with an easily melted, stable vitreous material with a viscosity between $10^2$ and $10^5$ poises at the sintering temperature and that it is compressed in a unidirectional press.

Thus, the invention consists, first, in "encapsulating" the metallic powder which must be procecessed. This is one of the phases of hot isostatic pressing during which the mass of the powder is charged in a capsule similar in shape to the final casting, moreover, a charging which can be done by vibrating the capsule to pack the powder and to improve its compactness. After filling, the capsule is connected to a vacuum pump to extract the air that it contains and to degasify the powder, then it is sealed.

This operation has as its object to avoid trapping inside the capsule gases that could cause porosities within the sintered casting.

The material constituting the capsule must be sufficiently ductile and thin to be able to be deformed without being torn under the action of the stresses to which it is subjected during heating and pressing. It must also not have any polluting action on the powder. This capsule can be made, for example, from a sheet of A-G3, an aluminum alloy containing about 3% magnesium.

In this encapsulating operation, a variant consists in introducing, into the capsule, powder having previously undergone a cold pressing, which does not eliminate the necessity of having to evacuate the gases before closing.

This capsule is then subjected to the process according to the invention, namely, first of all, that it is coated over its entire surface with a vitreous material. This material can have different compositions such as those known especially in the techniques for glass extrusion of aluminum. But it must have the properties of being easily melted and shaped, at a temperature near the sintering temperature of the processed powder, a liquid whose viscosity is between $10^2$ and $10^5$ poises at the processing temperature. The viscosity of this material must not be too low so as to stick to the surface of the capsule, nor too high so as to remain fluid. Morever, this material must be stable (i.e., especially must not recrystallize) during the period of the operation.

Coating of the capsule can be done by spraying with a gun, coating by brush or by dipping into the molten material or by any other suitable process. Preferably, it should be uniform.

The capsule thus coated is then placed in the mold of a unidirectional press, this mold having a shape approximately close to that of the capsule, then brought to a sintering temperature which can be between 450° and 550° C. and subjected to the action of the punch which can exert a pressure up to 800 MPa.

After having stayed for a predetermined time under the appropriate conditions of pressure and temperature suited to the nature of the powder used, the casting obtained is then freed by machining or by chemical processing of its coating consisting of the wall of the capsule and the vitreous material.

Examination of this casting shows then that, surprisingly, the mechanical properties such as hardness, mechanical strength and elongation, measured in different parts of the casting, each exhibit a remarkable uniformity, as if this uniformity had been achieved by isostatic pressing. This phenomenon can be explained by the role played by the vitreous material which, when it is heated, behaves like the fluid used in isostatic pressing, i.e., it does not transmit the pressure exerted by the punch in a favored direction, but distributes it regularly on all the faces of the product. The result of the process according to the invention is therefore to make it possible to consolidate in the same process the advantages characteristic of each of the types of uniaxial and isostatic pressing and to eliminate the drawbacks. Moreover, this process provides the possibility of working in a uniaxial press simultaneously at very high pressures and temperatures.

This invention can be illustrated with the following embodiment:

Some powder of aluminum alloyed with magnesium, zinc and copper with a granulometry of 15 μm FISCHER was charged in a cylindrical capsule 12.5 cm in diameter and 30 cm high, consisting of a sheet of aluminum alloy of the A-G3 type, 0.2 cm thick and that exhibited a lid provided with a pipe intended to be connected to a vacuum pumping unit. After the capsule was put in a vacuum, the pipe was closed by welding. The capsule was then heated and coated by a gun with a film of a vitreous material which melted on contact with the sheet. The capsule thus coated was placed in the mold of a unidirectional press with a diameter close to that of the capsule, then brought to a temperature of 500° C. The punch of the press was then lowered to exert a pressure of 700 MPa, a pressure that was maintained for 5 minutes. The punch having been rasied, the capsule was removed and a machining was performed to strip the sintered casting totally. This sintered casting was then subjected to a heat treatment of the T6 type and the Brinell hardness was measured at various points of its surface: the values obtained varied between 160 and 170.

This shows that it is possible, according to the invention, to attain, from the viewpoint of homogeneity of the castings, the characteristics of an isostatic press by using simply a unidirectional press in a temperature range of 450° to 550° C. and, moreover, by profiting from its advantages.

The invention applies, in powder metallurgy, to the obtaining of castings that exhibit homogeneous properties equivalent to or greater than those obtained by traditional metallurgy, these castings being able to be roughcasts or finished castings.

We claim:

1. A process for sintering aluminum alloy powders under pressure in a capsule which comprises:

(a) coating the entire surface of the capsule containing said aluminum alloy powders with a vitreous material having a viscosity of 100–100,000 poises at the sintering temperature; and (b) compressing said coated capsule in a unidirectional press and heating said capsule at a temperature of 450°–550° C., thereby sintering said alloy powders.

2. The process as in claim 1, wherein the powder placed in the capsule is degassed in a vacuum before sintering under pressure.

3. The process as in claim 1, wherein the powder is compressed before being placed in the capsule.

4. The process as in claim 1, wherein the capsule is made of an aluminum alloy having 3% magnesium.

5. The process as in claim 1, wherein the pressure applied is up to 800 MPa.

6. The process as in claim 1, wherein the sintering temperature is between 450° and 550° C.

7. The vitreous material of claim 1, wherein said vitreous material does not recrystallize during the sintering process.

8. A process for sintering aluminum alloy powders comprising:

(a) filling a capsule, which is similar in shape to a final product and is sufficiently ductile and thin to be deformed without being torn, with an aluminum alloy powder;

(b) connecting the capsule, after filling, to a vacuum pump thereby extracting the air in the capsule and degasifying the powder;

(c) coating the entire surface of the capsule with a vitreous material having a viscosity of between $10^2$ and $10^5$ poises, at the sintering temperature;

(d) placing the capsule in the chamber of a unidirectional press;

(e) subjecting the capsule to a sintering temperature between 450° and 550° C.; and (f) subjecting the capsule to the punch action of a unidirectional press under a pressure of up to 800 MPa.

9. The process for sintering aluminum alloy powders as set forth in claim 8, wherein said powder in the capsule has previously undergone a cold pressing.

10. The process for sintering aluminum alloy powders as set forth in claim 8, wherein the capsule is made from a sheet of an aluminum alloy containing about 3% magnesium.

* * * * *